US008068764B2

(12) United States Patent
Sakaguchi et al.

(10) Patent No.: US 8,068,764 B2
(45) Date of Patent: Nov. 29, 2011

(54) IMAGE FORMING DEVICE

(75) Inventors: Masatoshi Sakaguchi, Gifu (JP); Isao Kishi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 665 days.

(21) Appl. No.: 11/964,191

(22) Filed: Dec. 26, 2007

(65) Prior Publication Data

US 2008/0152386 A1 Jun. 26, 2008

(30) Foreign Application Priority Data

Dec. 26, 2006 (JP) ..... 2006-348966

(51) Int. Cl.
*G03G 15/00* (2006.01)

(52) U.S. Cl. ..... 399/118; 399/111; 399/179

(58) Field of Classification Search ..... 399/110, 399/111, 114, 179, 118
See application file for complete search history.

(56) References Cited

U.S. PATENT DOCUMENTS

| | | | | |
|---|---|---|---|---|
| 5,708,907 | A | 1/1998 | Masuda et al. | |
| 6,023,594 | A * | 2/2000 | Okiyama et al. | 399/12 |
| 6,075,957 | A * | 6/2000 | Batori et al. | 399/114 |
| 2003/0235430 | A1 * | 12/2003 | Koshida | 399/124 |
| 2005/0111858 | A1 * | 5/2005 | Nakazato | 399/12 |

FOREIGN PATENT DOCUMENTS

| | | |
|---|---|---|
| JP | 05-241386 | 9/1993 |
| JP | 05-249767 | 9/1993 |
| JP | 08-069162 | 3/1996 |
| JP | 11-346084 | 12/1999 |
| JP | 2003-112446 | 4/2003 |

* cited by examiner

*Primary Examiner* — David Porta
*Assistant Examiner* — Benjamin Schmitt
(74) *Attorney, Agent, or Firm* — Banner & Witcoff, Ltd

(57) ABSTRACT

An image forming includes a main body, an exposing unit, a process cartridge, and a positioning unit. The exposing unit is fixed to the main body and includes an exposing member. The process cartridge is attachable to an attaching portion provided on at least one of the main body and the exposing unit, and includes a photosensitive drum. The positioning unit positions the process cartridge with respect to the exposing unit so that the photosensitive drum faces the exposing member in a first direction when the process cartridge is attached to the attaching portion, allowing the photosensitive drum to be exposed by the exposing member.

57 Claims, 6 Drawing Sheets

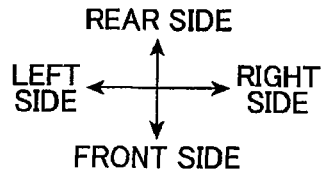
FIG.3A
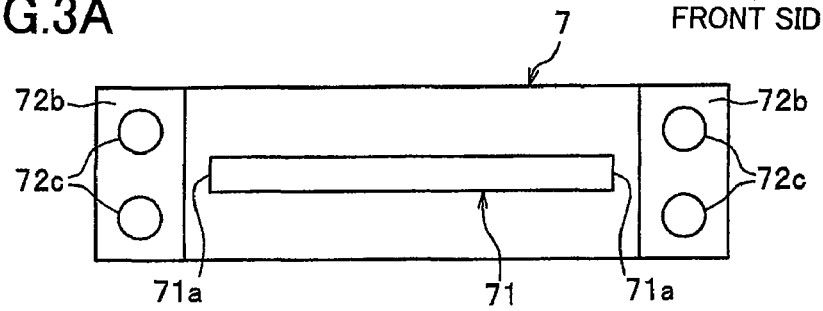
FIG.3B
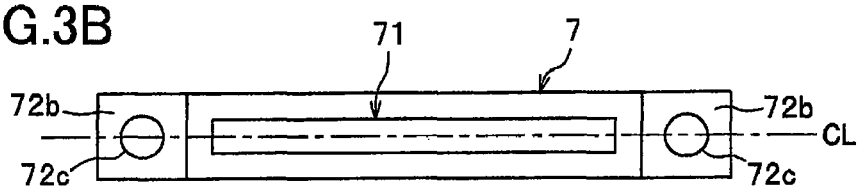
FIG.3C
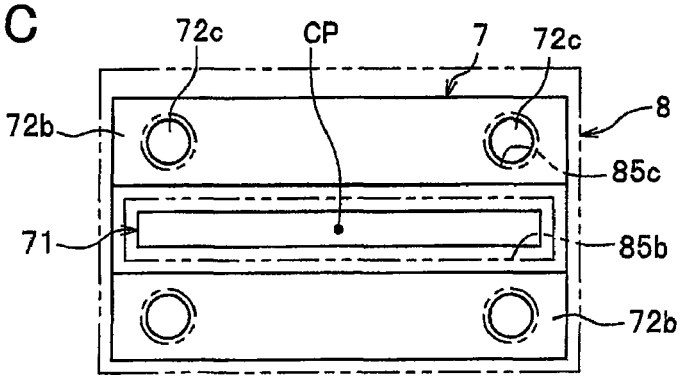
FIG.3D
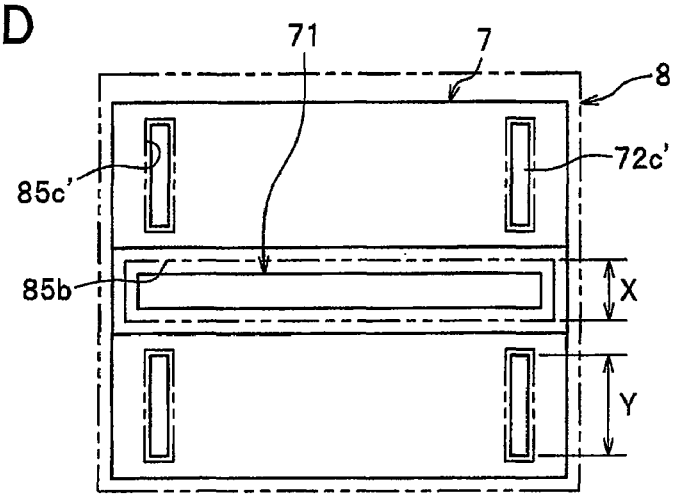

IMAGE FORMING DEVICE

CROSS REFERENCE TO RELATED APPLICATION

This application claims priority from Japanese Patent Application No. 2006-348966 filed Dec. 26, 2006. The entire content of each of these priority applications is incorporated herein by reference.

TECHNICAL FIELD

The present invention relates to an image forming device provided with an LED head and a process cartridge.

BACKGROUND

In general, an image forming device is configured to: irradiate an electrically charged photosensitive drum with a light to change the potential of the irradiated portion on the photosensitive drum to thereby form an electrostatic latent image on the photosensitive drum; supply the electrostatic latent image with a developer to form a developer image; and transfer the developer image onto a recording sheet, whereby a predetermined image is formed on the recording sheet.

As such an image forming device, there is known one having an LED head for emitting a light which is swingably supported by the device body through an arm and a process cartridge provided with a photosensitive drum which is detachably attached to the device body (Refer to Japanese Patent Application Publication No. 5-249767). In this image forming device, when a cover is closed after attachment of the process cartridge, the arm is swung by a mechanism that is activated by being brought into contact with a part of the cover, causing the LED head to come close to a photosensitive drum provided in the process cartridge for positioning. That is, after the position of the process cartridge with respect to the device body has been set, the position of the LED head with respect to the process cartridge is determined. Note that the positioning of the LED head and process cartridge is achieved by an engagement between a positioning hole formed on the LED head side and a projection formed on the process cartridge side.

However, according to a conventional technique, the position of the LED head is determined with respect to the process cartridge, so that the positioning accuracy of the LED head with respect to the device body may deteriorate due to influence of a positioning error between the device body and process cartridge and positioning error between the process cartridge and LED head. When the positioning accuracy of the LED head with respect to the device body deteriorates as described above, the positioning accuracy between a recording sheet which is fed while being positioned with respect to the device body and LED head correspondingly deteriorates, the printing position may shift.

SUMMARY

In view of the above-described drawbacks, it is an objective of the present invention to provide an image forming device capable of increasing the positioning accuracy of the LED head with respect to the device body.

In order to attain the above and other objects, the present invention provides an image forming including a main body, an exposing unit, a process cartridge, and a positioning unit. The exposing unit is fixed to the main body and includes an exposing member. The process cartridge is attachable to an attaching portion provided on at least one of the main body and the exposing unit, and includes a photosensitive drum. The positioning unit positions the process cartridge with respect to the exposing unit so that the photosensitive drum faces the exposing member in a first direction when the process cartridge is attached to the attaching portion, allowing the photosensitive drum to be exposed by the exposing member.

BRIEF DESCRIPTION OF THE DRAWINGS

The particular features and advantages of the invention as well as other objects will become apparent from the following description taken in connection with the accompanying drawings, in which:

FIG. 3A is a plan view showing an example in which the positioning projections are arranged in the longitudinal direction outside of the LED head;

FIG. 3B is a plan view showing an example in which the positioning projections are arranged on the center line of the LED head;

FIG. 3C is a plan view showing an example in which the positioning projections are symmetrically arranged with respect to the center of the LED head;

FIG. 3D is a plan view showing an example in which the positioning projections are each formed into a square pole shape;

DETAILED DESCRIPTION

First Embodiment

Figure 1A:
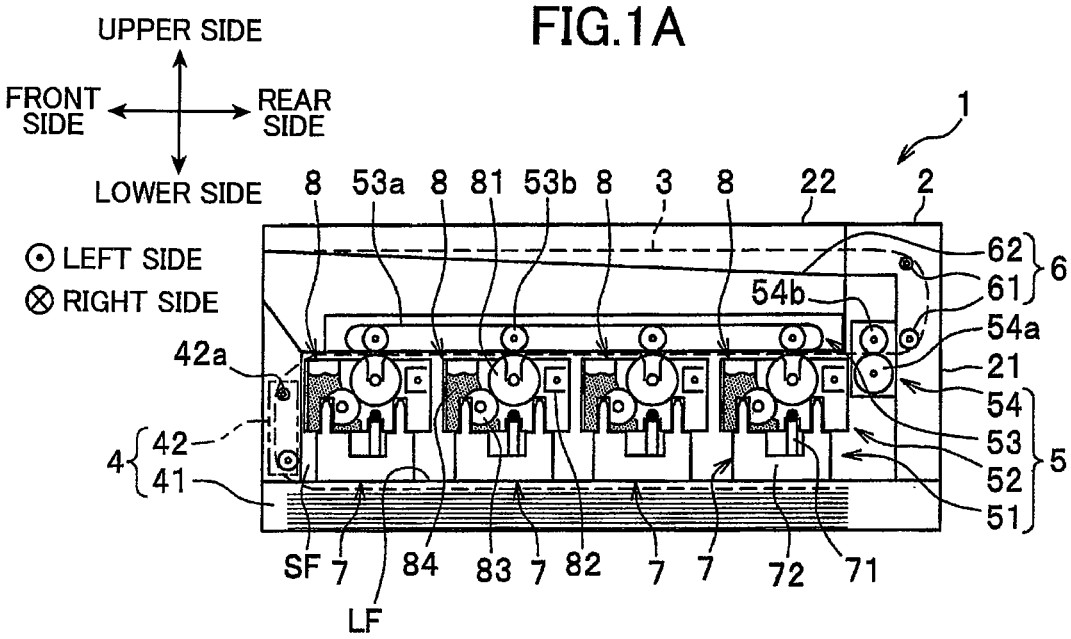
FIG. 1A is a side cross-sectional view of a color printer according to a first embodiment showing a state where printing operation is performed for a recording sheet.
Figure 1B:
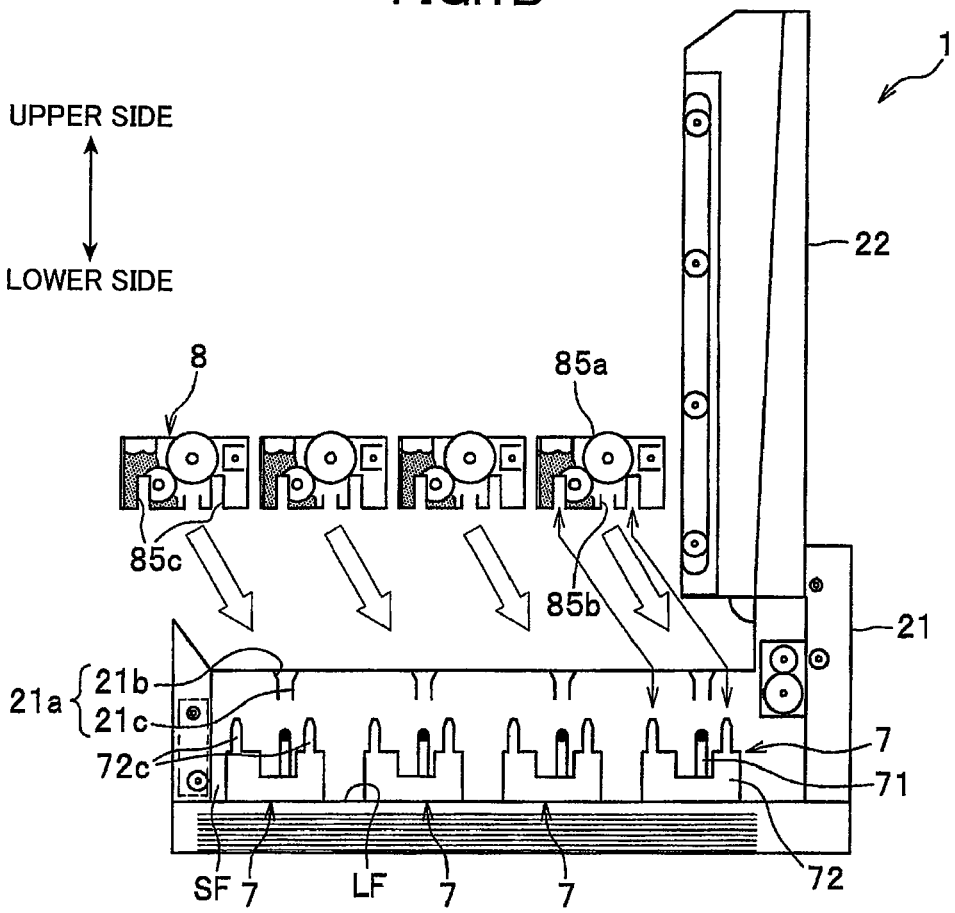
FIG. 1B is a side cross-sectional view of the color printer according to the first embodiments showing a state where a process cartridge is attached to the body of the color printer.

A first embodiment of the present invention will be described in detail below with reference to the accompanying drawings. FIGS. 1A and 1B are views showing a color printer according to the first embodiment, FIG. 1A is a side cross-sectional view showing a state where printing operation is performed for a recording sheet and FIG. 1B is a side cross-sectional view showing a state where a process cartridge is attached to the body of the color printer. In the following description, the entire configuration of the color printer will briefly be described first, and then a characteristic part of the present invention will be described in detail. In FIG. 1A, the left side of the drawing is referred to as "front side", the right side thereof as "rear side", the front side thereof as "left side", the back side thereof as "right side", the upper side thereof as "upper side", and the lower side thereof as "lower side".

<Entire Configuration of Color Printer>

As shown in FIG. 1A, a color printer 1, which is an electrophotographic- and tandem-type printer, has a casing-like main body 2, a sheet supply section 4 for supplying a recording sheet 3, an image forming section 5 for forming an image onto the supplied recording sheet 3, and a sheet discharge section 6 for discharging the recording sheet 3 onto which an image has been formed. The "tandem-type printer" refers to a printer having a plurality of photosensitive drums arranged in a line. More specifically, the "tandem-type printer" refers to a printer in which a plurality of (four) photosensitive drums have their rotary shafts extending in parallel to each other and are arranged in the direction perpendicular to the extending direction of the rotary shafts and images formed respectively on the photosensitive drums are superimposed onto a recording sheet or intermediate transfer belt (intermediate transfer member).

[Main Body 2]

The main body 2 has a casing 21 having an opening in the upper portion thereof and a cover portion 22 (see FIG. 1B) swingably mounted in the upper portion of the casing 21.

[Sheet Supply Section 4]

The sheet supply section 4 includes a sheet supply tray 41 detachably attached to the lower portion of the casing 21 of the main body 2 and a sheet supply mechanism 42 for feeding a plurality of recording sheets 3 one by one from the sheet supply tray 41 to the image forming section 5. Various types of rollers 42*a* such as a paper dust removing roller and pinch roller and a separation pad (not shown) are provided in the sheet supply mechanism 42.

[Image Forming Section 5]

The image forming section 5 has an exposure section 51, a process section 52, a transfer section 53, and a fixing section 54.

The exposure section 51 is constituted by four exposure units 7 each having an LED head 71. The LED head 71 has a plurality of LEDs (Light Emitting Diodes) arranged in a predetermined pattern. In the exposure section 51, the respective LEDs of the LED head 71 are appropriately turned on/off based on image data to blink a light for irradiation onto a photosensitive drum 81 to be described later.

The process section 52 is constituted by four process cartridges 8 arranged between the exposure section 51 and the transfer section 53. A photosensitive drum 81, a scorotron charger 82, a developing roller 83, a toner container 84, and a layer thickness restricting blade (not shown) are provided in each process cartridge 8. Toners of respective colors of cyan, magenta, yellow, and black are, respectively, contained in the respective toner containers 84 of the process cartridge 8.

In the process section 52, after being positively charged uniformly by the scorotron charger 82, the surface of the photosensitive drum 81 is exposed to a light from the exposure section 51. As a result, the potential of the exposed portion is decreased to form an electrostatic latent image based on image data. The "electrostatic latent image" refers to the area exposed to light by the laser beam and having a lowered electric potential, out of the surface of the photosensitive drum 81 that has been positively charged uniformly. Thereafter, when a toner carried on the developing roller 83 comes into contact with the photosensitive drum 81 by the rotation of the developing roller 83, the toner is supplied to the electrostatic latent image that has been formed on the surface of the photosensitive drum 81. Then, the toner is selectively carried on the surface of the photosensitive drum 81, whereby the toner image is visualized. In this manner, a toner image is formed by a reverse development method.

The transfer section 53 mainly includes a conveyor belt 53*a* for feeding the recording sheet 3 and transfer rollers 53*b*. In the transfer section 53, a toner image carried by the photosensitive drum 81 is attracted by each of the transfer rollers 53*b* to which a voltage has been applied and thereby transferred onto the recording sheet 3 fed between the photosensitive drum 81 and the conveyor belt 53*a*. In this manner, toner images on the four photosensitive drums 81 are superimposed onto the recording medium 3.

The fixing section 54 has a heating roller 54*a* and a pressurizing roller 54*b* pressed against the heating roller 54*a*. In the fixing section 54, a toner transferred onto the recording sheet 3 is thermally fixed while the recording sheet 3 is fed between the heating roller 54*a* and pressuring roller 54*b*.

[Sheet Discharge Section 6]

The sheet discharge section 6 has sheet discharge rollers 61 and a sheet discharge tray 62. In the sheet discharge section 6, the recording paper 3 from the fixing section 54 is fed onto the discharge tray 62 by means of the respective sheet discharge rollers 61.

<Positioning Structure between Exposure Unit and Process Cartridge>

Figure 2A:
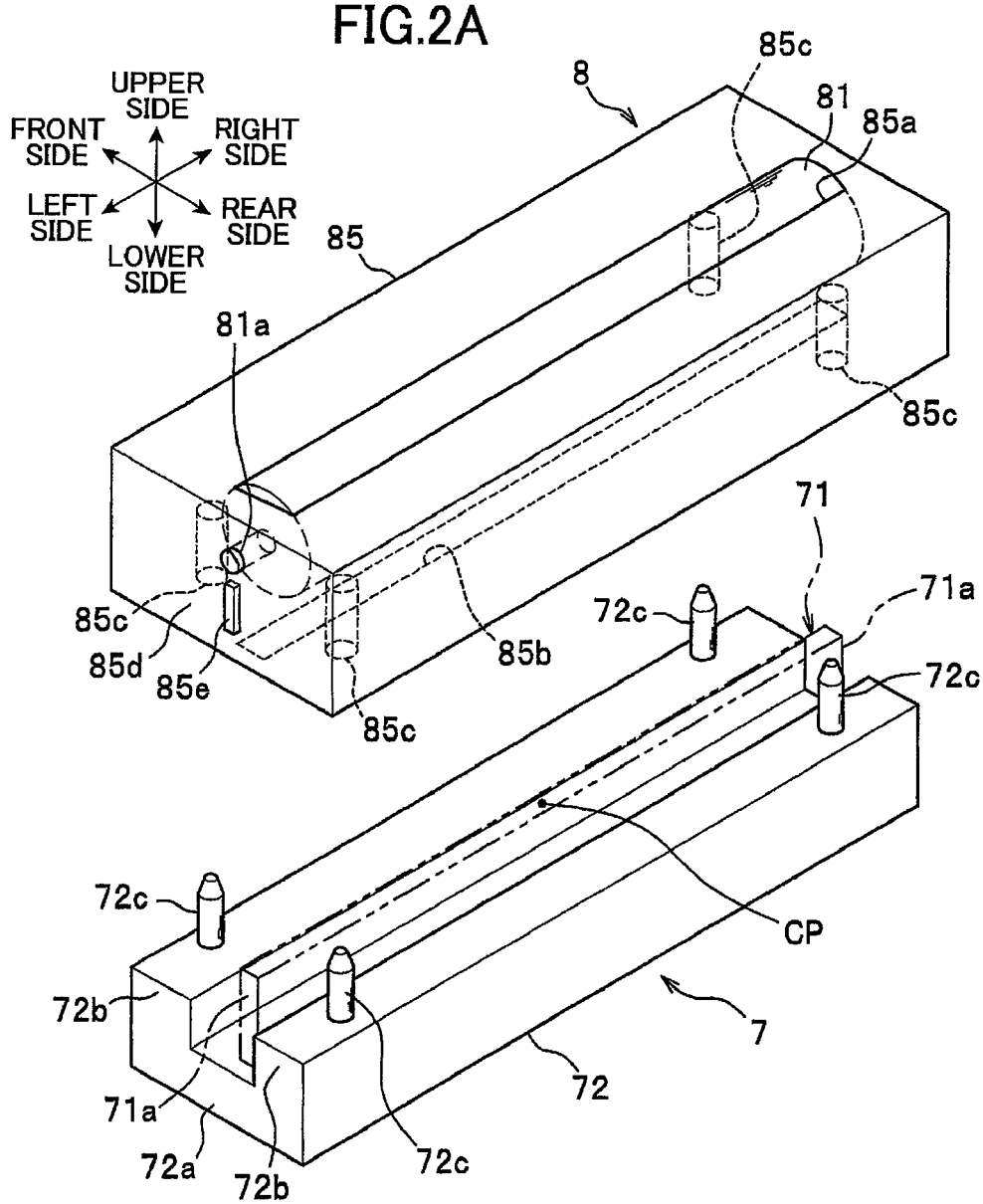
FIG. 2A is a perspective view showing the exposure unit and process cartridge.
Figure 2B:
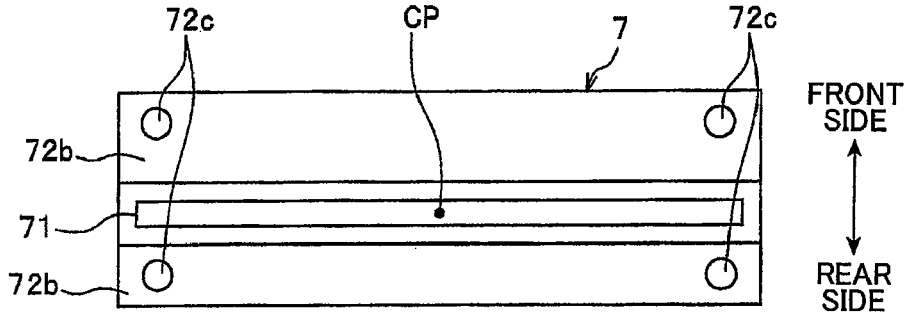
FIG. 2B is a plan view showing the exposure unit.

Next, a positioning structure between the exposure unit 7 and process cartridge 8 which is a characteristic part of the present invention will be described in detail. FIG. 2A is a perspective view showing the exposure unit and process cartridge, and FIG. 2B is a plan view showing the exposure unit.

[Exposure Unit 7]

As shown in FIG. 1B, the casing 21 has a pair of side frames SF and a lower frame LF. The side frames SF are disposed opposite to each other with the exposure unit 7 interposed therebetween and extending in the left-right direction. The lower frame LF is disposed under the exposure unit 7. The four exposure units 7 are fixed to both the side frames SF and lower frame LF. More specifically, each exposure unit 7 is fixed to an appropriate position (upper side of the sheet supply tray 41) of the side frames SF in an non-displaceable manner with the leading end of the LED head 71 facing upward (upper side in the vertical direction). In addition to the above-mentioned LED head 71, each exposure unit 7 has an exposure side frame 72 for supporting the LED head 71, as shown in FIG. 2A.

The exposure side frame 72 has a base portion 72*a* for supporting the LED head 71, a pair of pedestal portions 72*b* protruding upward from both width-direction sides (both sides in the feeding direction of the recording sheet 3, i.e., both sides in the front-back direction) of the base portion 72*a*, and four positioning projections 72*c* disposed on the upper surface of the pedestal portions 72*b*.

The positioning projection 72*c* is a columnar projection having a tapered leading end. The leading end of the positioning projection 72*c* is projected upward (process cartridge 8 side) higher than the leading end of the LED head 71. As shown in FIG. 2B, two of the four positioning projections 72*c* are disposed on the width-direction (front-rear direction) outside on the broader pedestal portion 72*b* formed on the front side, and remaining two are disposed on the width-direction center on the narrower pedestal portion 72*b* formed on the rear side. That is, the respective positioning projections 72*c* are asymmetrically arranged with respect to a center CP of the LED head 71 as viewed from above. Note that the LED head 71 has a rectangular shape as viewed from above, and the "center CP" indicates the point at which the perpendicular bisector of a short side of the rectangular and that of a long side thereof cross each other. Further, the respective positioning projections 72*c* are located inside relative to longitudinal direction (left-right direction) both end portions 71*a* of the LED head 71 as viewed from above.

[Process Cartridge]

As shown in FIG. 1B, the process cartridge 8 is configured to be detachable upward from the casing 21 of the main body 2, more specifically, detachable upward from the exposure unit 7 fixed to the lower side of the casing 21. In addition to the above-mentioned photosensitive drum 81, as shown in FIG. 2A, each process cartridge 8 has a process side frame 85 for supporting the photosensitive drum 81. An opening 85*a* for transfer is formed on the upper surface of the process side frame 85, and an opening 85*b* for head and four engagement holes 85*c* are formed on the lower surface thereof.

The opening 85*a* for transfer is an opening for exposing a part of the photosensitive drum 81 to the transfer roller 53*b* (see FIGS. 1A and 1B). The opening 85*a* for transfer is formed into a rectangular shape having short sides each having a length shorter than the diameter of the photosensitive drum 81 and long sides each having substantially the same length as that of the photosensitive drum 81.

The opening 85*b* for head is an opening for exposing the photosensitive drum 81 to the LED head 71 and is formed in the position opposite to the opening 85*a* for transfer. The opening 85*b* for head is formed to be slightly larger than the size of the LED head 71 as viewed from above so that the LED head 71 can be inserted into a position near the photosensitive drum 81 in the process cartridge 8.

The engagement hole 85*c* is an engagement part engaged with the abovementioned positioning projection 72*c*. The engagement hole 85*c* is formed to have substantially the same diameter as that of the positioning projection 72*c*. This engagement between the engagement hole 85*c* and positioning projection 72*c* allows positioning and fixation of the process cartridge 8 with respect to the exposure unit 7.

At the upper potions of a pair of process side frame side walls 85*d* that support the photosensitive drum 81, both ends of a shaft 81*a* of the photosensitive drum 81 protrude outward from the side walls 85*d*; and at the lower portions thereof, elongated guide pieces 85*e* are so formed as to extend in the vertical direction with a protruding amount substantially the same as that of the shaft 81*a*. The end portion of the shaft 81*a* and guide piece 85*e* are vertically arranged in a line on both the side walls 85*d*.

[Main Body 2]

As shown in FIG. 1B, four guide grooves 21*a* are formed in the opening portion of the casing 21 of the main body 2. Each guide groove 21*a* is engaged with the guide piece 85*e* and shaft 81*a* of the photosensitive drum 81 to thereby guide the shaft 81*a* of the photosensitive 81 to a predetermined position. The guide groove 21*a* is constituted by a tapered portion 21*b* gradually becoming narrower toward the LED head 71 and a straight portion 21*c* formed continuously from the narrowest portion of the tapered portion 21*b*. The width of the straight portion 21*c* is larger than the diameter of the shaft 81*a* of the photosensitive drum 81.

The straight portion 21*c* is a guide groove finally guiding the process cartridge 8 toward the LED head 71. The guide direction lower end of the straight portion 21*c* extends in the vertically downward direction which is directly opposite to the vertically upward direction in which the leading end of the LED head 71 extends. With this configuration, the process cartridge 8 is finally guided in the direction directly opposite to the direction in which the leading end of the LED head 71 extends.

A positioning method of the LED head 71 and photosensitive drum 81 will next be described.

As shown in FIG. 1B, the exposure side frames 72 of the four exposure units 7 are fixed to appropriate positions of the casing 21 of the main body 2 in an non-displaceable manner. Since the exposure unit 7 need not be detachable, the exposure side frame 72 just has to be fixed to the casing 21 by a known positioning means with a satisfactory accuracy. The fixation between the exposure side frame 72 and the casing 21 is achieved by, e.g., screwing, adhesion, or welding. Thus, the positioning of the LED head 71 on the exposure side frame 72 with respect to the main body 2 is achieved.

Subsequently, the process cartridges 8 are attached to the respective exposure units 7 that have been fixed to the casing 21 from above. At this time, an operator uses the opening 85*a* for transfer formed on the upper surface of the process cartridge 8 as a guide (i.e., operator regards the opening 85*a* for transfer as the opening 85*b* for head). Thus, the process cartridge 8 is inserted into the casing 21 from above while the positioning between the opening 85*b* for head and LED head 71 is conducted.

When the process cartridge 8 is inserted into the casing 21 while the rough position of the process cartridge 8 is visually confirmed, the guide pieces 85*e* of the process cartridge 8 and tapered portions 21*b* of the guide grooves 21*a* of the casing 21 are engaged with each other. Thus, even if the position of the process cartridge 8 is displaced from the proper position, the process cartridge 8 is set back to substantially the correct position by the tapered portions 21*b* of the guide grooves 21*a*.

After that, when the process cartridge 8 is inserted downward, the engagement holes 85*c* of the process cartridge 8 and tapered leading ends of the positioning projections 72*c* of the exposure unit 7 are engaged with each other. Thus, even if the position of the process cartridge 8 is displaced from the proper position, the process cartridge 8 is set back to the correct position by the tapered leading ends of the positioning projections 72*c*. If the engagement holes 85*c* are not engaged with the positioning projections 72*c* (i.e., the positions of the engagement holes 85*c* and positioning projections 72*c* are displaced largely from each other) when the process cartridge 8 is attached to the exposure unit 7, the lower surface of the process cartridge 8 is supported by the positioning projections 72*c*, thus protecting the LED head 71 from being damaged.

When the process cartridge 8 is further inserted downward while keeping the engagement between the positioning projections 72*c* and engagement holes 85*c* to bring the lower surface of the process cartridge 8 contact with the pedestal portions 72*b* of the exposure side frame 72, the position of the process cartridge 8 with respect to the exposure unit 7 is fixed to thereby achieve the positioning between the LED head 71 and the photosensitive drum 81.

According to the above embodiment, the following advantages can be obtained.

Since the exposure unit 7 having the LED head 71 is fixed to the main body 2 in a non-displaceable manner, the positioning accuracy of the LED head 71 with respect to the main body 2 can be increased. Further, the positioning of the photosensitive drum 81 with respect to the LED head 71 which has been fixed to the main body 2 is achieved to thereby increase the position accuracy of the photosensitive drum 81 with respect to the main body 2. This satisfactory positioning accuracy between the LED head 71 and the main body 2 and between the photosensitive drum 81 and the main body 2 results in an increase in the positioning accuracy between the main body 2 and the recording sheet 3, preventing a printing position shift.

Further, the fixation of the exposure unit 7 having the LED head 71 to the main body 2 in non-displaceable manner eliminates the need to provide a space or mechanism for swinging the LED head, which has been required in conventional approaches, thereby realizing miniaturization of the entire device and achieving cost-reduction due to a reduction in the number of parts. In a conventional configuration, the positioning operations must be carried out at least three times (i.e., positioning of the mechanism for swinging the LED head with respect to the main body, positioning of the process cartridge with respect to the main body, and positioning of the LED head with respect to the process cartridges). On the other hand, in the present embodiment, only two of the positioning operations (i.e., positioning of the exposure unit 7 with respect to the main body 2 and positioning of the process cartridge 8 to the exposure unit 7 (main body 2)) are required, thereby reducing installation error as much as possible.

The LED head 71 is so disposed in the main body 2 as to face upward, so that a user can visually confirm the condition of the LED head 71 from above in a state where the process cartridge 8 is removed. This facilitates maintenance or cleaning of the LED head 71. Further, the four LED heads 71 are fixed to the common side frames SF and lower frame LF through the respective exposure side frames 72, thereby increasing the positioning accuracy between the LED heads 71, which suppresses occurrence of color shift.

The leading end of the positioning projection 72*c* is projected upward higher than the leading end of the LED head 71, which can suppresses interference between the process cartridge 8 and LED head 71 at the time of attachment of the process cartridge 8. In a configuration in which the process cartridge 8 having a heavy weight is attached to the LED head 71 that has been fixed to the main body 2 as in the case of the present embodiment, there is a possibility that the LED head 71 and process cartridge 8 may strongly collide with each other to damage the LED head 71. Therefore, such a configuration in which the LED head 71 is protected by the positioning projection 72*c* is a highly effective means.

Since the guide groove 21*a* having the tapered portion 21*b* gradually becoming narrower toward the LED head 71 is formed in the main body 2, attachment/detachment of the process cartridge 8 to/from the main body 2 can easily be performed.

The leading end of the positioning projection 72*c* is formed into a tapered shape, whereby even if the position of the process cartridge 8 is slightly displaced from the proper position, the process cartridge 8 can be set back to the correct position, thus facilitating the positioning of the process cartridge 8.

The opening 85*a* for transfer is formed in the position opposite to the opening 85*b* for head, so that an operator can perform the attachment work while regarding the opening 85*a* for transfer as the opening 85*b* for head. This facilitates the attachment work without newly providing a marker for facilitating the attachment work.

The positioning projection 72*c* is formed on the pedestal portion 72*b* protruding upward from the base portion 72*a*, thereby preventing the length of the positioning projection 72*c* from being increased more than necessary, which can increase the strength of the positioning projection 72*c*.

The present invention is not limited to the first embodiment but can be embodied in various forms as follows.

Although the positioning projections 72*c* are located inside relative to longitudinal direction both end portions 71*a* of the LED head 71 in the first embodiment, the present invention is not limited to this configuration, but the positioning projections 72*c* may be located outside relative to longitudinal direction both end portions 71*a* as shown in FIG. 3A. With this configuration, the distance between a pair of the positioning projections 72*c* disposed on the widthwise direction both sides of the LED head 71 can be reduced. Accordingly, the size of the exposure unit 7 can be reduced in the widthwise direction (sheet feeding direction) (as viewed from above) of the LED head 71. Further, with the size reduction of the exposure unit 7, the size of the process cartridge 8 can be reduced in the sheet feeding direction.

Further, the number of the positioning projections 72*c* is not limited to four as in the first embodiment but any number of the positioning projections 72*c* may be used. For example, the four positioning projections 72*c* used in the configuration shown in FIG. 3A can be reduced to two as shown in FIG. 3B. In this case, as shown in FIG. 3B, the two positioning projections 72*c* are preferably disposed on a center line CL extending in the longitudinal direction (as viewed from above) of the LED head 71. Note that the LED head 71 has a rectangular shape as viewed from above, and the "center line CL" indicates the perpendicular bisector of short sides of the rectangular. According to this configuration, the size of the exposure unit 7 and that of the process cartridge 8 can further be reduced in the sheet feeding direction.

Although the four positioning projections 72*c* are asymmetrically arranged with respect to the center of the LED head 71, the present invention is not limited to this configuration. For example, as shown in FIG. 3C, the four positioning projections 72*c* may be symmetrically arranged with respect to the center CP of the LED head 71 as viewed from above. Note that the LED head 71 has a rectangular shape as viewed from above, and the "center CP"indicates the point at which the perpendicular bisector of a short side of the rectangular and that of a long side thereof cross each other. With this configuration, the positioning projections 72*c* are disposed in a well-balanced manner around the LED head 71, thereby effectively protecting the LED head 71 by the positioning projections 72*c*. Further, the position of the LED head 71 can be estimated from the positioning projections 72*c* symmetrically arranged with respect to the center of the LED head 71. This prevents an operator from erroneously touching the LED head 71 to prevent dirt from being attached to the LED head 71. Further, even if the process cartridge 8 is erroneously attached with the direction (as viewed from above) of the process cartridge 8 reversed, the LED head 71 can be prevented from colliding with the lower surface of the process cartridge 8 and is allowed to escape in the process cartridge 8 through the opening 85*b* for head. Incidentally, as representatively shown in FIG. 2B, in the case where the positioning projections 72*c* are asymmetrically arranged, if the process cartridge 8 is attached with the direction (as viewed from above) of the process cartridge 8 reversed, the LED head 71 collides with the lower surface of the process cartridge 8. However, in the first embodiment which has been described using FIGS. 2A and 2B, even if the process cartridge 8 is attached with the direction (as viewed from above) of the process cartridge 8 reversed, engagement of the guide pieces 85*e* of the process cartridge 8 with the guide grooves 21*a* of the main body 2 prevents the positioning projections 72*c* from being inserted into the engagement holes 85*c*, thereby preventing the LED head 71 from being damaged by the lower surface of the process cartridge 8.

Further, although the positioning projection 72*c* is formed into a columnar shape in the first embodiment, the present invention is not limited to this, but the positioning projection 72*c* may be formed into any shape. For example, as shown in FIG. 3D, a positioning projection 72*c*' may be formed into a square pole shape. In this case, an engagement hole 85*c*' of the process cartridge 8 is formed into a rectangular shape. Further, the longitudinal width Y (sheet feeding direction width, i.e., front-rear direction width) of the positioning projection 72*c*' is preferably larger than the short side width X (sheet feeding direction width) of the opening 85*b* for head of the process cartridge 8. With this configuration, the positioning projection 72*c*'does not go into the opening 85*b* for head, so that if a user attaches the process cartridge 8 to the main body 2 in a wrong manner, a contact between the positioning projections 72*c*' and the photosensitive drum 81 can be prevented.

Although the process cartridge 8 is fixed to the exposure unit 7 in the first embodiment, the present invention is not limited to this configuration. For example, the process cartridge 8 may be fixed to the main body 2. Further, the fixation of the process cartridge 8 is not limited to the engagement but any fixation structure can be adopted. For example, the fixation may be achieved by hooking a given locking piece or an elastically deformable engagement projection onto the exposure unit 7 or the main body 2.

Although the positioning projections 72*c* and the engagement holes 85*c* are formed, as a positioning means, respectively in the exposure unit 7 and the process cartridge 8 in the first embodiment, the present invention is not limited to this configuration but may employ another configuration wherein the positioning projections 72*c* are formed in the process cartridge 8 and engagement holes 85*c* are formed in the exposure unit 7 or wherein both the engagement holes and positioning projections are formed respectively in the exposure unit 7 and the process cartridge 8.

Although the engagement hole 85*c* is adopted as an engagement unit in the first embodiment, the present invention is not limited to this but a groove may be used as the engagement means.

Figure 4A:
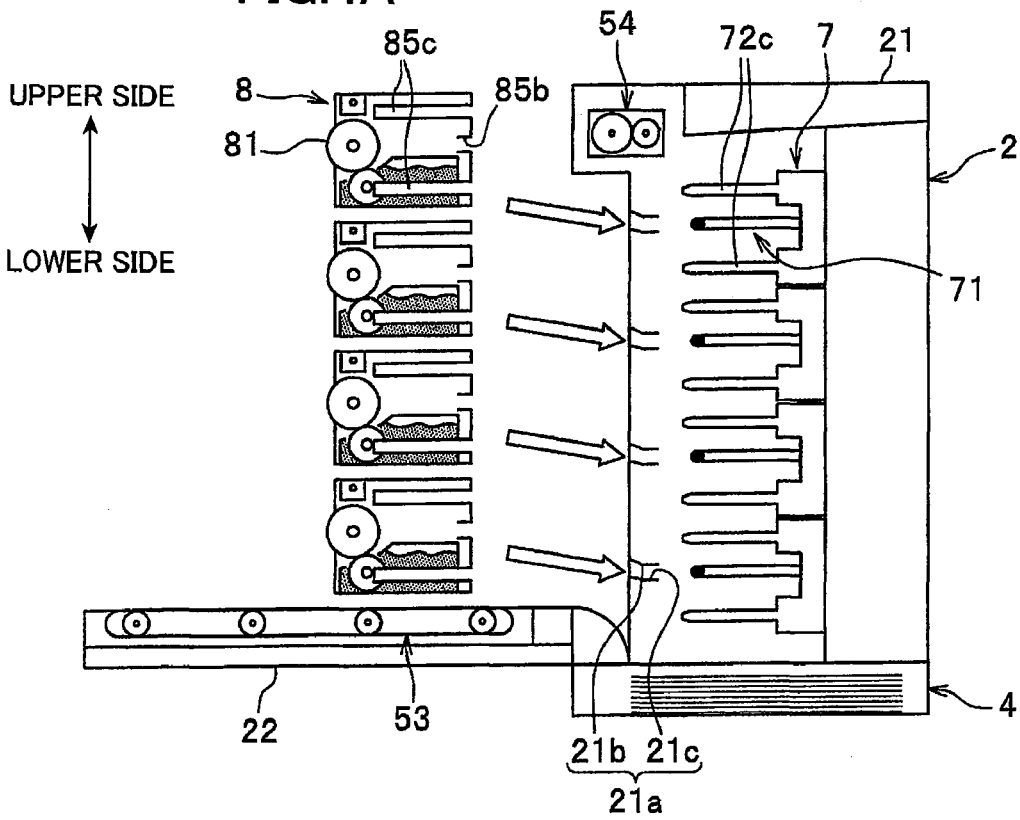
FIG. 4A is a side cross-sectional view showing a state before attachment of the process cartridge to the main body.
Figure 4B:
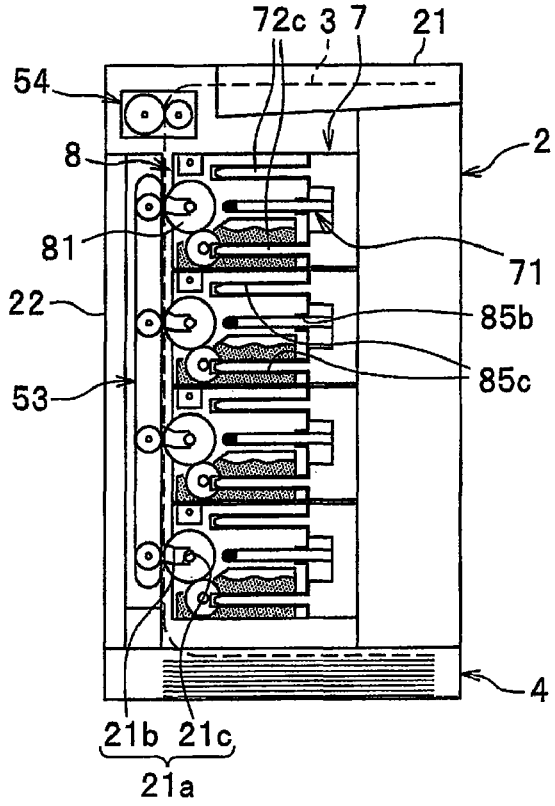
FIG. 4B is a side cross-sectional view showing a state after attachment of the process cartridge to the main body.

Although the process cartridge 8 is attached from above in the first embodiment, the present invention is not limited to this configuration. For example, as shown in FIGS. 4A and 4B, a configuration wherein the process cartridge 8 is attached from the side may be adopted. The configuration of a color printer shown in FIGS. 4A and 4B is the same as that shown in FIGS. 1A and 1B except the attachment direction of the process cartridge 8 and the same reference numerals as those in FIGS. 1A and 1B denote the same or corresponding parts as those in FIGS. 1A and 1B, and the descriptions thereof will be omitted here.

Second Embodiment

Figure 5A:
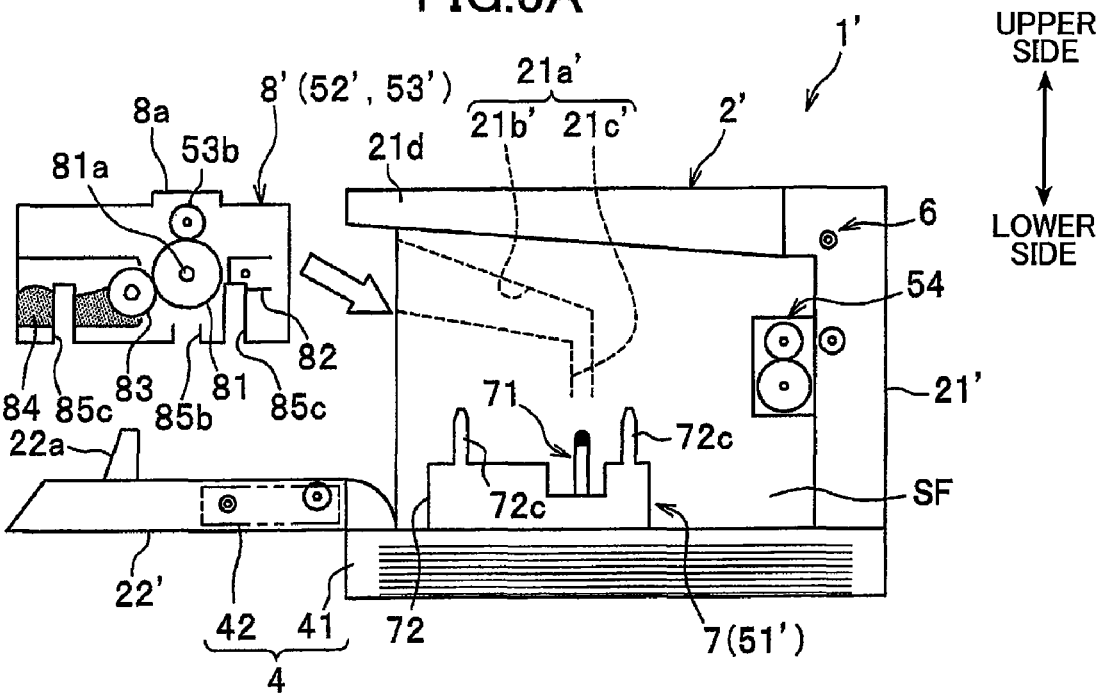
FIG. 5A is a side cross-sectional view of a color printer according to a second embodiment showing a state before attachment of the process cartridge to the main body.
Figure 5B:
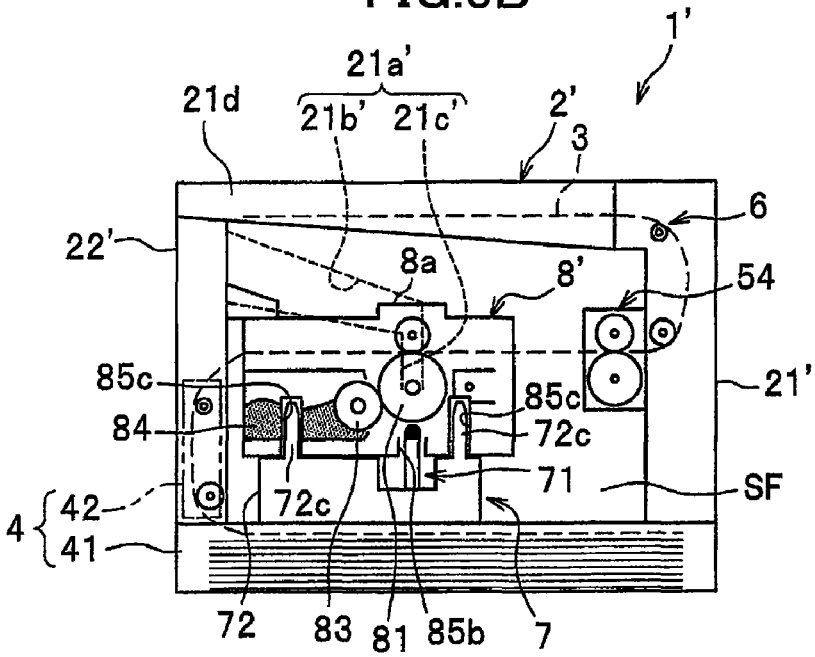
FIG. 5B is a side cross-sectional view of the color printer according to the second embodiment showing a state after attachment of the process cartridge to the main body.

A second embodiment of the present invention will next be described in detail with reference to the accompanying drawings. The second embodiment refers to a monochrome printer 1'. In the drawings, the same reference numerals as the drawings in the first embodiment denote the same or corresponding parts as the drawings in the first embodiment, and the descriptions thereof will be omitted here. FIGS. 5A and 5B are views showing a printer according to the second embodiment of the present invention, FIG. 5A is a side cross-sectional view showing a state before attachment of the process cartridge to the main body, and FIG. 5B is a side cross-sectional view showing a state after attachment of the process cartridge to the main body.

As shown in FIGS. 5A and 5B, a printer 1' includes a main body 2', an exposure section 51', a process section 52' and a transfer section 53' all of which have different configurations from those of the first embodiment.

[Main Body 2']

The main body 2' has a casing 21' having an opening in the side portion thereof and a cover portion 22' swingably mounted in the opening of the casing 21'. A guide groove 21*a*' for guiding the shaft 81*a* of the photosensitive drum 81 of a process cartridge 8' to a predetermined position extends from an appropriate location of the opening inside the casing 21'. The guide groove 21*a*' is constituted by a tapered portion 21*b*' gradually becoming narrower toward the LED head 71 and a straight portion 21*c*' formed continuously from the narrowest portion of the tapered portion 21*b*'. The tapered portion 21*b*' extends in the horizontal direction and straight portion 21*c*' extends downward. A holder piece 22*a* contacting the upper surface of the process cartridge 8' and a sheet supply mechanism 42 constituting the sheet supply section 4 are formed in the cover portion 22'.

The straight portion 21*c*' is a guide groove finally guiding the process cartridge 8' toward the LED head 71. The guide direction lower end of the straight portion 21*c*' extends in the vertically downward direction which is directly opposite to the vertically upward direction in which the leading end of the LED head 71 extends. With this configuration, the process cartridge 8' is finally guided in the direction directly opposite to the direction in which the leading end of the LED head 71 extends.

[Exposure Section 51']

The exposure section 51' is constituted by one exposure unit 7. The exposure unit 7 has the same configuration as that of the first embodiment, and the description thereof will be omitted.

[Process Section 52' and Transfer Section 53']

The process section 52' and the transfer section 53' are constituted by one process cartridge 8'. That is, the process cartridge 8' integrally includes the transfer roller 53*b* in addition to the configuration of the process cartridge 8 of the first embodiment. The transfer roller 53*b* is provided in the upper portion of the photosensitive drum 81. A part of the upper wall of the process cartridge 8' that faces the transfer roller 53*b* is formed as a convex portion 8*a* protruding upward. When the recoding sheet 3 supplied from the sheet supply section 4 is interposed between the photosensitive drum 81 and the transfer roller 53*b*, a toner image formed on the photosensitive drum 81 is transferred onto the recording sheet 3.

A positioning method of the LED head 71 and the photosensitive drum 81 will next be described.

As shown in FIG. 5A, the exposure side frame 72 of the exposure unit 7 is fixed to an appropriate position of the casing 21' of the main body 2' in the same manner as described in the first embodiment. Thus, the positioning of the LED head 71 on the exposure side frame 72 with respect to the main body 2' is achieved.

Subsequently, when the process cartridge 8' is inserted from the side into the casing 21', the shaft 81*a* of the photosensitive drum 81 and the tapered portion 21*b*' of the guide groove 21*a*' of the casing 21' are engaged with each other. Thus, even if the position of the shaft 81*a* of the photosensitive drum 81 is displaced slightly upward from the upper opening of the straight portion 21*c*', the shaft 81*a* is set back to the upper opening of the straight portion 21*c*' by the tapered portion 21*b*'.

After the shaft 81*a* of the photosensitive drum 81 is moved to the upper opening of the straight portion 21*c*' (that is, after the shaft 81*a* of the photosensitive drum 81 is hit by a sheet feeding downstream side wall of the guide groove 21*a*'), the process cartridge 8' is moved downward. At this time, when the convex portion 8*a* is pressed to move down the process cartridge 8', the shaft 81*a* of the photosensitive drum 81 is smoothly moved along the straight portion 21*c*'. Thereafter, as in the case of the first embodiment, the engagement holes 85*c* of the process cartridge 8' and positioning projections 72*c* of the exposure unit 7 are engaged with each other to conduct the positioning between the LED head 71 and the photosensitive drum 81. Finally, when the cover portion 22' is closed, the upper surface of the process cartridge 8' is pressed down by the holder piece 22*a* to thereby reliably fix the process cartridge 8' to the exposure unit 7.

According to the second embodiment, the following advantage can be obtained in addition to the advantages of the first embodiment.

The holder piece 22*a* is provided in the cover portion 22', so that even if the process cartridge 8' is spaced from the upper surface of the exposure unit 7, the process cartridge 8' is pressed down by the holder piece 22*a* to be brought into contact with the upper surface of the exposure unit 7, thereby reliably achieving the positioning.

Third Embodiment

Figure 6A:
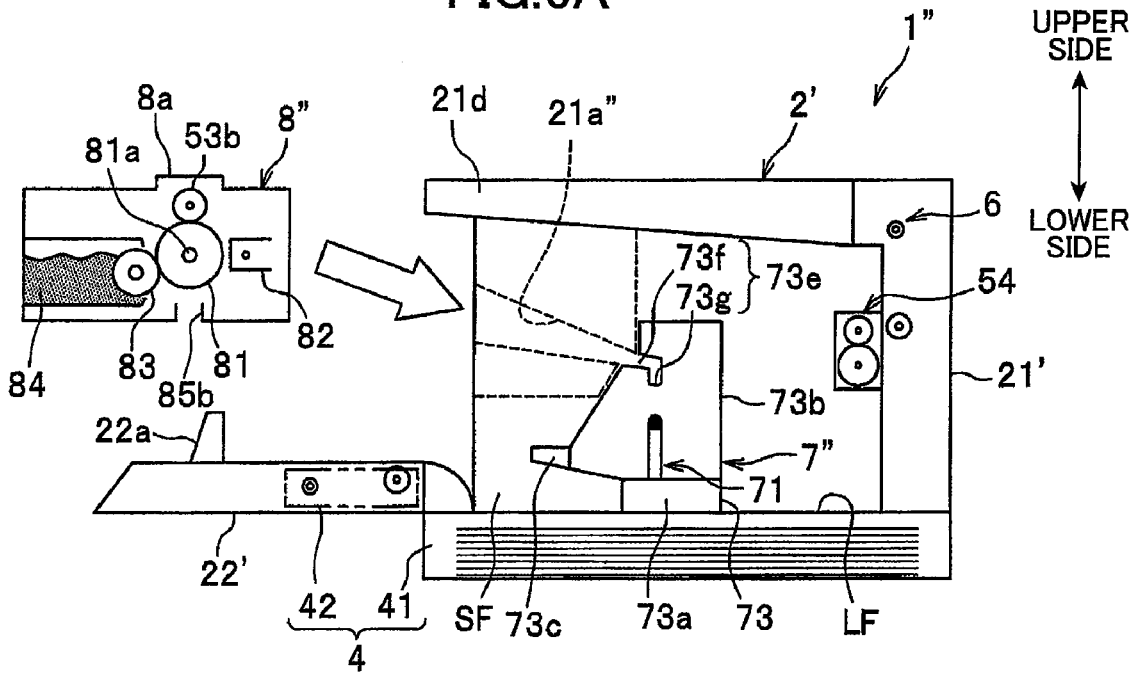
FIG. 6A is a side cross-sectional view of a color printer according to a third embodiment showing a state before attachment of the process cartridge to the main body.
Figure 6B:
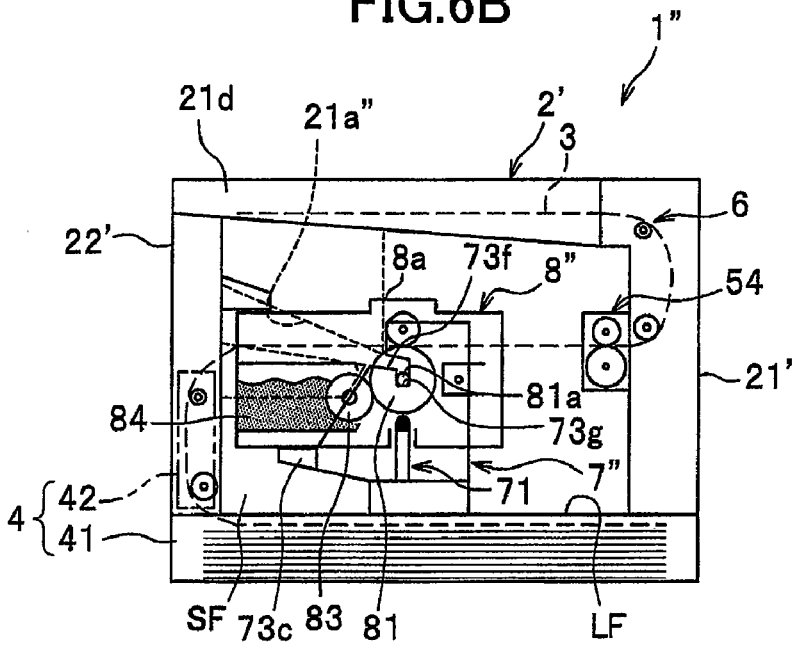
FIG. 6B is a side cross-sectional view of the color printer according to the third embodiment showing a state after attachment of the process cartridge to the main body.

A third embodiment of the present invention will next be described in detail with reference to the accompanying drawings. The third embodiment refers to a modification of the configuration of the monochrome printer 1' according to the second embodiment. In the drawings, the same reference numerals as the drawings in the second embodiment denote the same or corresponding parts as the drawings in the second embodiment, and the descriptions thereof will be omitted here. FIGS. 6A and 6B are views showing a printer according to the third embodiment of the present invention, FIG. 6A is a side cross-sectional view showing a state before attachment of the process cartridge to the main body, and FIG. 6B is a side cross-sectional view showing a state after attachment of the process cartridge to the main body.

As shown in FIGS. 6A and 6B, a printer 1"includes an exposure unit 7", a process cartridge 8" and a guide groove 21*a*" all of which have different configurations from those of the printer 1' according to the second embodiment.

The exposure unit 7" is so fixed to the side frames SF and lower frame LF as to face upward and includes the LED head 71 having the same configuration as that of the second embodiment and exposure side frame 73 having the different configuration from that of the second embodiment. The exposure side frame 73 has a base portion 73*a* for supporting the LED head 71, a pair of shaft support portions 73*b* protruding upward from the left-right direction both end portions of the base portion 73*a*, and a cartridge support portion 73*c* connecting the pair of the shaft support portions 73*b*.

A positioning groove 73*e* for positioning the shaft 81*a* of the photosensitive drum 81 with respect to the LED head 71 is formed at an appropriate position of the upper portion of the shaft support portion 73*b* on the opening side of the casing 21'. The positioning groove 73*e* is constituted by a tapered portion 73*f* gradually becoming narrower toward the LED head 71 and a straight portion 73*g* formed continuously from the narrowest portion of the tapered portion 73*f*. The width of the straight portion 73*g* is substantially the same as the diameter of the shaft 81*a* of the photosensitive drum 81.

The straight portion 73*g* is a guide groove finally guiding the process cartridge 8" toward the LED head 71. The guide direction lower end of the straight portion 73*g* extends in the vertically downward direction which is directly opposite to the vertically upward direction in which the leading end of the LED head 71 extends. With this configuration, the process cartridge 8" is finally guided in the direction directly opposite to the direction in which the leading end of the LED head 71 extends.

The cartridge support portion 73*c* is formed at the leading end of the portion protruding toward the opening side of the casing 21' from the lower portion of the shaft support portion 73*b*. The cartridge support portion 73*c* is configured to support the lower surface of the process cartridge 8" by the upper surface thereof.

The process cartridge 8" differs from the process cartridge 8' of the second embodiment in that the engagement holes 85*c* as shown in FIG. 5 are not formed.

The guide groove 21*a*" is so formed as to gradually become narrower toward the LED head 71. More specifically, the guide groove 21*a*" is formed into a shape continued from the tapered portion 73*f* of the positioning groove 73*e* of the exposure side frame 73.

A positioning method of the LED head 71 and the photosensitive drum 81 will next be described.

As shown in FIG. 6A, the exposure side frame 73 of the exposure unit 7" is fixed to an appropriate position of the casing 21' of the main body 2' in the same manner as described in the first embodiment. Thus, the positioning of the LED head 71 on the exposure side frame 73 with respect to the main body 2' is achieved.

Subsequently, when the process cartridge 8" is inserted from the side into the casing 21', the shaft 81*a* of the photosensitive drum 81 and the guide groove 21*a*" of the casing 21' are engaged with each other. Thus, even if the position of the shaft 81*a* of the photosensitive drum 81 is displaced slightly upward from the upper opening of the straight portion 73*g*, the shaft 81*a* is set back to the upper opening of the straight portion 73*g* by the guide groove 21*a*"and the tapered portion 73*f* of the positioning groove 73*e*.

After the shaft 81*a* of the photosensitive drum 81 is moved to the upper opening of the straight portion 73*g* of the positioning groove 73*e* (that is, after the shaft 81*a* of the photosensitive drum 81 is hit by a sheet feeding downstream side wall of the positioning groove 73*e*), the process cartridge 8" is moved downward. At this time, when the convex portion 8*a* is pressed to move down the process cartridge 8", the shaft 81*a* of the photosensitive drum 81 is smoothly moved along the straight portion 73*g*. Thereafter, the process cartridge 8" is inserted downward until the shaft 8la of the photosensitive drum 81 is brought into contact with the lower end of the straight portion 73*g*, whereby the positioning between the LED head 71 and the photosensitive drum 81 is achieved. At this time, the lower surface of the process cartridge 8" contacts the cartridge support portion 73*c* of the exposure side frame 73, whereby the process cartridge 8" is favorably supported by the lower end of the straight portion 73*g* and the cartridge support portion 73*c*. Finally, when the cover portion 22' is closed, the upper surface of the process cartridge 8" is pressed down by the holder piece 22*a* to thereby reliably fix the process cartridge 8" to the exposure unit 7".

According to the third embodiment, the following advantage can be obtained in addition to the advantages of the second embodiment.

The positioning can be achieved by the engagement between the shaft 81*a* of the photosensitive drum 81 and the positioning groove 73*e*, allowing the photosensitive drum 81 to be directly positioned with respect to the exposure side frame 73. Thus, the positioning accuracy between the photosensitive drum and the LED head on the exposure side frame can be increased as compared to a configuration like the second embodiment in which the position of the casing of the process cartridge 8'is determined with respect to the exposure side frame 72 to thereby indirectly achieve the positioning between the photosensitive drum 81 and the exposure side frame 72.

The guide groove 21*a*" gradually becoming narrower toward the LED head 71 and tapered portion 73*f* of the positioning groove 73*e* are provided, so that attachment/detachment of the process cartridge 8" to/from the exposure unit 7" becomes easier.

The cartridge support portion 73*c* is formed in the exposure side frame 73, so that the process cartridge 8"can reliably be fixed between the cartridge support portion 73*c* and the holder piece 22*a*.

Although the present invention has been described with respect to specific embodiments, it will be appreciated by one skilled in the art that a variety of changes may be made without departing from the scope of the invention.

For example, the present invention may be applied to other image forming devices such as a copier and an MFP (Multi-Function Peripheral).

What is claimed is:

1. An image forming device comprising:

a main body;

an exposing unit fixed to the main body and including an exposing member and an attaching portion;

a process cartridge attachable to the attaching portion, and including a photosensitive drum; and a positioning unit configured to position the process cartridge with respect to the exposing unit so that the photosensitive drum faces the exposing member in a first direction when the process cartridge is attached to the attaching portion, allowing the photosensitive drum to be exposed by the exposing member, wherein the positioning unit includes an engaging member provided on the attaching portion, and an engaged member provided on the process cartridge to be engaged with the engaging member, wherein the exposing member has a longitudinal length extending in a second direction orthogonal to the first direction, and a pair of second ends in the second direction, and wherein the engaging member is provided outside the pair of second ends in the second direction.

2. The image forming device according to claim 1, wherein the process cartridge attached to the attaching portion is disposed above the exposing unit so that the exposing member is visible from upward when the process cartridge is detached from the attaching portion.

3. The image forming device according to claim 1, further comprising:

a plurality of the exposing units each fixed to the main body; and a plurality of process cartridges each including a photosensitive drum, each photosensitive drum corresponding to each exposing unit to provide a tandem-type image forming device.

4. The image forming device according to claim 1, wherein the engaging member includes a protrusion protruding in the first direction, and the engaged member is formed with a hole engaged with the protrusion.

5. The image forming device according to claim 4, wherein the exposing unit has a first end in the first direction, the exposing member being disposed at the first end, wherein the protrusion protrudes toward the process cartridge relative to the exposing member.

6. The image forming device according to claim 4, wherein the protrusion has a tapered end.

7. The image forming device according to claim 4, wherein the exposing unit includes a pedestal portion from which the protrusion protrudes.

8. The image forming device according to claim 1, wherein the exposing member has a longitudinal length extending in a second direction orthogonal to the first direction, and a width in a third direction orthogonal to both the first direction and the second direction, and wherein the engaging member is provided on a center line extending in the second direction and passing a center of the first width.

9. The image forming device according to claim 1, wherein the positioning unit includes at least a pair of the engaging members and a pair of the engaged members, wherein the exposing member has a longitudinal length extending in a second direction orthogonal to the first direction, and a pair of second ends in the second direction, and a width in a third direction orthogonal to both the first direction and the second direction, wherein the pair of the engaging members is symmetrically provided with respect to a point that is both a center of the longitudinal length and a center of the width.

10. The image forming device according to claim 1, wherein the positioning unit includes at least a pair of the engaging members and a pair of the engaged members, wherein the exposing member has a longitudinal length extending in a second direction orthogonal to the first direction, a pair of second ends in the second direction, and a width in a third direction orthogonal to both the first direction and the second direction, wherein the pair of the engaging members is asymmetrically provided with respect to a point that is both a center of the longitudinal length and a center of the width.

11. The image forming device according to claim 1, further comprising a guiding unit configured to guide the engaged member to the engaging member.

12. The image forming device according to claim 11, wherein the photosensitive drum includes a shaft, and the guiding unit includes a guiding groove formed in the exposing unit, with which the shaft is engaged.

13. The image forming device according to claim 12, wherein the guiding groove gradually becomes narrower as the engaged member approaches the engaging member.

14. The image forming device according to claim 12, wherein the guiding groove has a downstream portion having an end, the engaged member being engaged with the engaging member when the shaft is positioned at the end, the downstream portion extending in a direction opposite the first direction.

15. The image forming device according to claim 11, wherein the photosensitive drum includes a shaft, and the guiding unit includes a guiding groove formed in the main body, with which the shaft is engaged.

16. The image forming device according to claim 15, wherein the guiding groove gradually becomes narrower as the engaged member approaches the engaging member.

17. The image forming device according to claim 15, wherein the guiding groove has a downstream portion having an end, the engaged member being engaged with the engaging member when the shaft is positioned at the end, the downstream portion extending in a direction opposite the first direction.

18. The image forming device according to claim 1, wherein the main body includes a cover closable when the process cartridge is attached to the attaching portion, the cover including a holding member configured to hold the process cartridge attached to the attaching portion when the cover is closed.

19. The image forming device according to claim 1, wherein the exposing member includes a LED.

20. An image forming device comprising:

a main body;

an exposing unit fixed to the main body and including an exposing member and an attaching portion;

a process cartridge attachable to the attaching portion, and including a photosensitive drum; and a positioning unit configured to position the process cartridge with respect to the exposing unit so that the photosensitive drum faces the exposing member in a first direction when the process cartridge is attached to the attaching portion, allowing the photosensitive drum to be exposed by the exposing member, wherein the positioning unit includes an engaging member provided on the attaching portion, and an engaged member provided on the process cartridge to be engaged with the engaging member, wherein the exposing member has a longitudinal length extending in a second direction orthogonal to the first direction, and a pair of second ends in the second direction, and wherein the engaging member is provided between the pair of second ends in the second direction.

21. The image forming device according to claim 20, wherein the process cartridge attached to the attaching portion is disposed above the exposing unit so that the exposing member is visible from upward when the process cartridge is detached from the attaching portion.

22. The image forming device according to claim 20, further comprising:

a plurality of the exposing units each fixed to the main body; and a plurality of process cartridges each including a photosensitive drum, each photosensitive drum corresponding to each exposing unit to provide a tandem-type image forming device.

23. The image forming device according to claim 20, wherein the engaging member includes a protrusion protruding in the first direction, and the engaged member is formed with a hole engaged with the protrusion.

24. The image forming device according to claim 23, wherein the exposing unit has a first end in the first direction, the exposing member being disposed at the first end, wherein the protrusion protrudes toward the process cartridge relative to the exposing member.

25. The image forming device according to claim 23, wherein the protrusion has a tapered end.

26. The image forming device according to claim 23, wherein the exposing unit includes a pedestal portion from which the protrusion protrudes.

27. The image forming device according to claim 20, wherein the exposing member has a longitudinal length extending in a second direction orthogonal to the first direction, and a width in a third direction orthogonal to both the first direction and the second direction, and wherein the engaging member is provided on a center line extending in the second direction and passing a center of the first width.

28. The image forming device according to claim 20, wherein the positioning unit includes at least a pair of the engaging members and a pair of the engaged members, wherein the exposing member has a longitudinal length extending in a second direction orthogonal to the first direction, and a pair of second ends in the second direction, and a width in a third direction orthogonal to both the first direction and the second direction, wherein the pair of the engaging members is symmetrically provided with respect to a point that is both a center of the longitudinal length and a center of the width.

29. The image forming device according to claim 20, wherein the positioning unit includes at least a pair of the engaging members and a pair of the engaged members, wherein the exposing member has a longitudinal length extending in a second direction orthogonal to the first direction, a pair of second ends in the second direction, and a width in a third direction orthogonal to both the first direction and the second direction, wherein the pair of the engaging members is asymmetrically provided with respect to a point that is both a center of the longitudinal length and a center of the width.

30. The image forming device according to claim 20, further comprising a guiding unit configured to guide the engaged member to the engaging member.

31. The image forming device according to claim 30, wherein the photosensitive drum includes a shaft, and the guiding unit includes a guiding groove formed in the exposing unit, with which the shaft is engaged.

32. The image forming device according to claim 31, wherein the guiding groove gradually becomes narrower as the engaged member approaches the engaging member.

33. The image forming device according to claim 31, wherein the guiding groove has a downstream portion having an end, the engaged member being engaged with the engaging member when the shaft is positioned at the end, the downstream portion extending in a direction opposite the first direction.

34. The image forming device according to claim 30, wherein the photosensitive drum includes a shaft, and the guiding unit includes a guiding groove formed in the main body, with which the shaft is engaged.

35. The image forming device according to claim 34, wherein the guiding groove gradually becomes narrower as the engaged member approaches the engaging member.

36. The image forming device according to claim 34, wherein the guiding groove has a downstream portion having an end, the engaged member being engaged with the engaging member when the shaft is positioned at the end, the downstream portion extending in a direction opposite the first direction.

37. The image forming device according to claim 20, wherein the main body includes a cover closable when the process cartridge is attached to the attaching portion, the cover including a holding member configured to hold the process cartridge attached to the attaching portion when the cover is closed.

38. The image forming device according to claim 20, wherein the exposing member includes a LED.

39. An image forming device comprising:

a main body;

an exposing unit fixed to the main body and including an exposing member and an attaching portion;

a process cartridge attachable to the attaching portion, and including a photosensitive drum; and a positioning unit configured to position the process cartridge with respect to the exposing unit so that the photosensitive drum faces the exposing member in a first direction when the process cartridge is attached to the attaching portion, allowing the photosensitive drum to be exposed by the exposing member, wherein the positioning unit includes an engaging member provided on the attaching portion, and an engaged member provided on the process cartridge to be engaged with the engaging member, wherein the engaging member has a width in a second direction orthogonal to the first direction, and the process cartridge is formed with an opening through which the exposing member exposes the photosensitive drum, the opening having a width in the second direction, and wherein the width of the engaging member is larger than the width of the opening.

40. The image forming device according to claim 39, wherein the process cartridge attached to the attaching portion is disposed above the exposing unit so that the exposing member is visible from upward when the process cartridge is detached from the attaching portion.

41. The image forming device according to claim 39, further comprising:

a plurality of the exposing units each fixed to the main body; and a plurality of process cartridges each including a photosensitive drum, each photosensitive drum corresponding to each exposing unit to provide a tandem-type image forming device.

42. The image forming device according to claim 39, wherein the engaging member includes a protrusion protruding in the first direction, and the engaged member is formed with a hole engaged with the protrusion.

43. The image forming device according to claim 42, wherein the exposing unit has a first end in the first direction, the exposing member being disposed at the first end, wherein the protrusion protrudes toward the process cartridge relative to the exposing member.

44. The image forming device according to claim 42, wherein the protrusion has a tapered end.

45. The image forming device according to claim 42, wherein the exposing unit includes a pedestal portion from which the protrusion protrudes.

46. The image forming device according to claim 39, wherein the exposing member has a longitudinal length extending in a second direction orthogonal to the first direction, and a width in a third direction orthogonal to both the first direction and the second direction, and wherein the engaging member is provided on a center line extending in the second direction and passing a center of the first width.

47. The image forming device according to claim 39, wherein the positioning unit includes at least a pair of the engaging members and a pair of the engaged members, wherein the exposing member has a longitudinal length extending in a second direction orthogonal to the first direction, and a pair of second ends in the second direction, and a width in a third direction orthogonal to both the first direction and the second direction, wherein the pair of the engaging members is symmetrically provided with respect to a point that is both a center of the longitudinal length and a center of the width.

48. The image forming device according to claim 39, wherein the positioning unit includes at least a pair of the engaging members and a pair of the engaged members, wherein the exposing member has a longitudinal length extending in a second direction orthogonal to the first direction, a pair of second ends in the second direction, and a width in a third direction orthogonal to both the first direction and the second direction, wherein the pair of the engaging members is asymmetrically provided with respect to a point that is both a center of the longitudinal length and a center of the width.

49. The image forming device according to claim 39, further comprising a guiding unit configured to guide the engaged member to the engaging member.

50. The image forming device according to claim 49, wherein the photosensitive drum includes a shaft, and the guiding unit includes a guiding groove formed in the exposing unit, with which the shaft is engaged.

51. The image forming device according to claim 50, wherein the guiding groove gradually becomes narrower as the engaged member approaches the engaging member.

52. The image forming device according to claim 50, wherein the guiding groove has a downstream portion having an end, the engaged member being engaged with the engaging member when the shaft is positioned at the end, the downstream portion extending in a direction opposite the first direction.

53. The image forming device according to claim 49, wherein the photosensitive drum includes a shaft, and the guiding unit includes a guiding groove formed in the main body, with which the shaft is engaged.

54. The image forming device according to claim 53, wherein the guiding groove gradually becomes narrower as the engaged member approaches the engaging member.

55. The image forming device according to claim 53, wherein the guiding groove has a downstream portion having an end, the engaged member being engaged with the engaging member when the shaft is positioned at the end, the downstream portion extending in a direction opposite the first direction.

56. The image forming device according to claim 39, wherein the main body includes a cover closable when the process cartridge is attached to the attaching portion, the cover including a holding member configured to hold the process cartridge attached to the attaching portion when the cover is closed.

57. The image forming device according to claim 39, wherein the exposing member includes a LED.

* * * * *